US008810247B2

(12) United States Patent
Kuckes

(10) Patent No.: US 8,810,247 B2
(45) Date of Patent: Aug. 19, 2014

(54) ELECTROMAGNETIC ORIENTATION SYSTEM FOR DEEP WELLS

(75) Inventor: Arthur F. Kuckes, Ithaca, NY (US)

(73) Assignee: Halliburton Energy Services, Inc., Houston, TX (US)

( * ) Notice: Subject to any disclaimer, the term of this patent is extended or adjusted under 35 U.S.C. 154(b) by 383 days.

(21) Appl. No.: 13/182,299

(22) Filed: Jul. 13, 2011

(65) Prior Publication Data

US 2012/0013339 A1 Jan. 19, 2012

Related U.S. Application Data

(60) Provisional application No. 61/363,879, filed on Jul. 13, 2010.

(51) Int. Cl.
*G01V 3/02* (2006.01)
*E21B 47/022* (2012.01)

(52) U.S. Cl.
CPC ..... *E21B 47/02216* (2013.01)
USPC ..... 324/346

(58) Field of Classification Search
CPC ..... G01V 3/28; G01V 3/08; G01V 3/081; G01V 3/26; G01V 3/00; E21B 47/02224; E21B 47/02; E21B 47/02216; E21B 47/022; E21B 7/04; E21B 7/068; E21B 7/003
USPC ..... 324/346
See application file for complete search history.

(56) References Cited

U.S. PATENT DOCUMENTS

| | | | |
|---|---|---|---|
| 6,445,307 | B1 | 9/2002 | Rassi et al. |
| 2002/0057210 | A1 | 5/2002 | Frey et al. |
| 2003/0085059 | A1 | 5/2003 | Kuckes et al. |
| 2007/0126426 | A1 | 6/2007 | Clark et al. |
| 2008/0109167 | A1 | 5/2008 | Wang et al. |
| 2009/0260879 | A1 | 10/2009 | Clark et al. |
| 2010/0155138 | A1 | 6/2010 | Kuckes |

OTHER PUBLICATIONS

International Search Report, International Application No. PCT/US2011/043741, 2 pgs., Nov. 9, 2011.
International Preliminary Report on Patentability, International Application No. PCT/US2011/043741, 9 pgs., Jan. 15, 2013.

*Primary Examiner* — Reena Aurora
(74) *Attorney, Agent, or Firm* — Benjamin Fite; Baker Botts L.L.P.

(57) ABSTRACT

An electromagnetic method and apparatus for determining the azimuthal orientation of a drill bit instrumentation sub (70), with respect to a borehole bottom drilling assembly (150) includes an electromagnet (152) fastened to the drilling assembly to produce an auxiliary alternating electromagnetic field (162) having an axis (163) that is perpendicular to the borehole axis (160). The direction of the field lines (162) generated by this magnet (152) and the simultaneous measurement of an electromagnetic field (36) generated by current flow in a blowout well casing is measured by electromagnetic field sensors in the drill bit instrument sub (70) to determine the direction to a blowout The direction of the auxiliary field (162) produced by the electromagnet (152) makes it possible to determine the direction to the blowout with reference to the direction of drilling without using an intermediate parameter such as, for example, the direction of gravity.

15 Claims, 11 Drawing Sheets

Drill Bit Instrumentation sub (PRIOR ART)

Instrumentation package on wireline (PRIOR ART)

FEASIBILITY TEST CONFIGURATION

ELECTROMAGNETIC ORIENTATION SYSTEM FOR DEEP WELLS

CROSS REFERENCE TO RELATED APPLICATIONS

This application claims the benefit of U.S. Provisional Patent Application No. 61/363,879, of Arthur F. Kuckes, filed Jul. 13, 2010, and entitled "Electromagnetic Orientation System for Deep Wells," the disclosure of which is hereby incorporated herein in its entirety by reference. This application is also related to U.S. Patent Application Publication No. U.S.2010/0155138 A1 (the '138 publication), the disclosure of which is also hereby incorporated herein by reference.

BACKGROUND OF THE INVENTION

1. Field of the Invention

The present invention relates, in general, to methods and apparatus for locating the distance and direction to a conductive target, such as a cased well or borehole, from a remote location such as a rescue borehole or well to obtain data for use in guiding the direction of drilling the rescue well to intersect the target, and to methods and apparatus for injecting time-varying electrical currents into the earth from one or more electrodes in the rescue borehole, for detecting at the drill bit of the rescue well electromagnetic field vectors resulting from such injected currents flowing in the target, and for transmitting data representing the detected fields to the earth's surface. More particularly, the invention relates to a method and apparatus for guiding the drilling of a borehole when the rescue well is traveling in a direction very close to vertical and the direction of gravity almost coincides with the direction of drilling.

2. Description of the Related Art

It is well known that in drilling boreholes in the earth, such as deep wells for oil and gas exploration, precise control of the path followed by the well is extremely difficult, so that it is virtually impossible to know the exact location of the well at a given depth. For example, a drilling tolerance of plus or minus one quarter of a degree will allow the bottom of a 10,000-foot well to be positioned anywhere within a circle 100 feet in diameter, and numerous factors can increase the deviation. This is not of particular concern in many drilling operations, but if drilling precision is necessary, as where a borehole is to be drilled precisely to a target location, such variations can cause severe difficulties. One example of the need for precision drilling occurs in the situation where it becomes necessary to drill a relief well to intersect an existing deep well, as in the case where the casing of the deep well has ruptured and it becomes necessary to plug the well at or below the point of the rupture to bring it under control. In order to do this, the relief well must be drilled to intersect the original well at the desired level, and since such ruptures, or blowouts, often produce extremely hazardous conditions at the surface in the vicinity of the original well, the relief well usually must be started a considerable distance away from the original wellhead and drilled at an incline down to the desired point of intersection.

Because the same problems of control of the direction of drilling that were encountered in the original well are also encountered in drilling the relief well, the location of the relief well borehole also cannot be known with precision; accordingly, it is extremely difficult to determine the distance and direction from the end of the relief well to the desired point of intersection on the target well. In addition, the relief well usually is very complex, compounding the problem of knowing exactly where it is located with respect to a target that may be 10 inches in diameter at a distance of thousands of feet below the earth's surface.

Numerous early attempts were made to solve the problem of guiding a relief well to accurately intersect a target well. Some utilized surveying techniques to locate the relief well with respect to a target well, but such survey techniques are not capable of providing accurate data concerning the relationship of the relief well to the original well until the relief well has approached very near the original well. Magnetic gradient ranging equipment can be used with considerable accuracy at close range; however, it has been found that outside a radius of a few tens of feet, such systems are usually inadequate.

In an attempt to extend the distance at which accurate information can be obtained, a variety of electrical well logging techniques have been used which treat the target well as an anomaly in the geologic structure of the earth surrounding the relief well. Some of these systems are directed to the measurement of the apparent resistivity of the earth across a pair of electrodes but, since no directionality is given by this method, it is ineffective for directing a relief well toward an existing well.

In addition, there have been attempts to obtain similar data through the use of electromagnetic prospecting, where induction sensing coils mounted at right angles to each other are used in conjunction with other conventional well logging systems to determine the probable location of a target. However, such systems do not suggest the possibility of locating relatively small targets such as well bores.

Other systems have been developed for directing a second well with respect to a first well by the use of sonic detectors responsive to the sound produced by fluids flowing out of a blown well formation. However, such systems will not operate when there is no sound emanating from the target well, and, in addition, do not provide the required degree of directional and distance accuracy. Another proposal in the prior art is the use of a signal transmitter in one well and a signal receiver in the other well, wherein sound waves or magnetic fields may be used as the signals. In these latter systems, however, the target well must be accessible so that the signal source can be placed in one well and the receiver in the other, and they are not effective where the target well is not open.

Many of the difficulties outlined above were overcome in the prior art by methods and apparatus disclosed, for example, in U.S. Pat. Nos. 4,323,848, 4,372,398, 4,700,142, and 5,512,830, all issued to Arthur F. Kuckes, the applicant herein. In accordance with such prior art patents, an electric current flow is produced in a target such as the casing of a target well by injecting a low frequency alternating current into the earth surrounding the target well through the use of an electrode located in the relief well, or borehole. This current flow extends between the downhole electrode and a second electrode that may be located at the earth's surface in the vicinity of the head of the relief well. The injected earth current finds a path of least resistance through the casing or other current-conducting material in the target borehole, and the resulting concentration of current produces a characteristic magnetic field surrounding the target well which can be detected by an AC magnetic field sensor such as that described in U.S. Pat. No. 4,323,848, or by multiple sensors, as described in U.S. Pat. No. 5,512,830. These sensors are extremely sensitive to very small magnetic fields, and accurately detect the vectors of magnetic fields produced by currents flowing in well casings located a considerable distance away from the relief borehole.

The vector signals obtained from the AC magnetic field sensors, in accordance with the aforesaid patents, permit calculation of the direction and distance to the target well casing with respect to the location of the AC magnetic field sensor in the relief well. This information can be used to guide further drilling of the relief well. Thus, as the relief well approaches a desired depth, its approach to the location of the target well can be guided so that the target well is intersected at the desired depth below the earth's surface in a rapid and effective manner. This method of guiding a relief well to intersect with a target is a homing-in process, wherein multiple measurements—often after every 50 feet of drilling—must be made as the relief borehole approaches the target, so that more time is spent measuring than is spent drilling. This need for making so many measurements makes the drilling of a relief well very expensive, especially in off-shore drilling, wherein, using the prior methods, the drill string for the relief well must be pulled for each measurement.

The foregoing systems are widely, and successfully, used; however, each of them requires a periodic withdrawal of the drill string so that suitable sensors and electrodes for generating the ground current can be lowered into place and so that distance and direction measurements from the relief well to the target can be obtained. Since a drilling rig operation can cost upwards of $500,000.00 per day in offshore drilling operations, the time-consuming process of halting the drilling, withdrawing the drill string, and positioning the measuring equipment is an extremely expensive procedure Accordingly, a method and apparatus for making such measurements without the effort and expense of pulling the drill string is needed.

Furthermore, in a typical borehole drilling operation, the path of the borehole, which may be a relief well as described above, is tracked during drilling by a "measurement while drilling" (MWD) instrument that is mounted near the bottom of the drill string. Usually, such a string consists of a series of steel tubes, each about 10 meters in length and connected end-to-end. Connected at the bottom end of the drill string is a non-magnetic section which carries the MWD instrument, and below that, a hydraulic drilling motor having a bent housing to which the drill bit is connected via a drill shaft, with each of the non-magnetic section and the bent housing being about 10 meters in length. As a result of this, the MWD instrument is typically located 10-20 meters above the face of the drill bit, so that when magnetic field measurements are made with the drill string in the relief well, they are actually made a considerable distance from the drill bit, introducing a significant error in determination of the relative distance and direction of the target with respect to the drill bit. This greatly increases the difficulty of accurately controlling the intersection of the borehole being drilled with the target.

Accordingly, there was a need for a measurement system that will significantly increase the accuracy of distance and direction calculations in drilling, while reducing the cost of making such calculations.

Prior U.S. Patent Application Publication No. U.S.2010/0155138A1, referenced above, is directed to an improved method and apparatus for determining the distance and direction from the drill bit of a relief well drill string to a target location, such as the center of an existing borehole casing, without the need to withdraw the drill string to make the necessary measurements, while still making the measurements from the bottom of the relief well so that accurate calculations can be made. In accordance with one aspect of that invention, the need for pulling a drill string in order to make magnetic field measurements in a relief well, or borehole, is obviated by the use of magnetic field sensors mounted in a drill bit instrument package that is secured to the drill bit, in combination with a drill string wireline having a suitable current-injecting electrode and a wireline instrument package which can be dropped down through the center of the drill string whenever a measurement is to be made. The electrode is energized with a time-varying current to produce a corresponding magnetic field generated by current flow in the target, and the drill bit instrument detects that magnetic field at the drill bit. The drill bit instrument transmits data representing the measured field vectors, and the wireline instrument package receives that data and transmits it to the surface for use in guiding further drilling. The wireline is then withdrawn, and drilling can be resumed.

The foregoing process is carried out, in accordance with another aspect of that invention, by a modified drill string structure having at least one insulating segment, but preferably two such segments, spaced apart to electrically isolate a selected conventional tubular, electrically conductive, steel drill string pipe section near the bottom of the string to form a drill string electrode. These pipes are generally about ten meters in length and are joined end-to-end, with sections being added to the drill string as drilling progresses. Each insulating segment, or sub, is about one meter in length, so that a single sub is generally sufficient for electrical isolation, although additional subs may be used, as needed. The drill string preferably includes a single such electrode section, although in some circumstances it may be desirable to include two spaced electrode sections separated and isolated from each other by at least one insulating sub. If desired, they may be spaced further apart by including one or more non-electrode steel pipe sections between the insulating subs for the electrode sections. The modified drill string includes a non-magnetic segment, in which is mounted a conventional MWD instrument, and the lowermost (distal) end of the drill string is a standard rotating drill bit connected to the shaft of a standard hydraulic drilling motor incorporating, in a preferred form of the invention, a bent housing for directional drilling control, in known manner. As is known, the drilling motor may be driven by drilling fluid that flows down the center of the drill string and back up the borehole outside the string.

When a magnetic field measurement is to be made using the drill string of the invention disclosed in the '138 publication, drilling is halted, and instead of withdrawing the drill string, a wireline carrying a wireline electrode is lowered through the center of the drill string until the wireline electrode is aligned with the approximate center of the corresponding isolated steel drill pipe electrode section. The wireline electrode is in electrical communication with its corresponding isolated steel drill pipe electrode section which is, in turn, in electrical communication with the surrounding earth formations. When the wireline is energized, the drill pipe electrode injects current from the wireline electrode into the surrounding formations and a portion of that current is then collected in the target. The electrodes are energized by a periodic time-varying current, such as a sinusoidal AC supplied from a power supply at the earth's surface, to produce a characteristic target current and corresponding target magnetic field. The wireline electrode is immersed in the drilling fluid, which may be electrically conductive to provide electrical communication between it and its corresponding drill pipe electrode. In the case where a non-conductive drilling fluid is used, spring-loaded contacts may be employed on the wireline electrode to provide a positive electrical contact with the inner surface of the isolated steel drill pipe section.

In accordance with the '138 publication, the desired magnetic field measurements are made at the drill bit sensor, or magnetic field detector, that is located in the drill bit instrument package described above. This location for the drill bit sensor is advantageous, because it is close to the actual location of the drill bit that is to be controlled. The drill bit instrument is battery-operated, and in addition to suitable magnetic field vector detectors and gravity vector detectors, it incorporates suitable electromagnetic telemetry, such as an electromagnetic solenoid, for transmitting data from the drill bit sensor instrument to the wireline instrument in the drill string. The wireline instrument includes suitable telemetry to remotely receive the data from the drill bit sensor and to transmit that data to the surface.

In another embodiment of the invention described in the aforementioned '138 publication, magnetic field measurement accuracy may be improved in some circumstances by operating the system in a pulsed transient mode, wherein the earth formations surrounding the relief and the target wells are energized by a stepped, or pulsed, primary excitation current from a power source which preferably is at the surface, and measurements of magnetic fields produced by the resulting current flow in the target are made immediately following a stepwise turn-off of the excitation current, when that current is zero. Each pulse of electrical energy supplied to the wireline electrode causes a current to flow through the earth's formations to the target, and, as described in the foregoing U.S. Pat. No. 4,700,142, this current is collected on the electrically conductive target. The resulting target current flow creates a characteristic target magnetic field that is detected by the drill bit sensor instrument. In the pulsed, or transient, mode of operation of the device, the magnetic field measurement is made after the primary energizing current stops. The magnetic fields that are measured when the excitation current is zero are caused by a decaying target well current flow. Although this decay current produces only a very small field, since even the primary target current typically is only a few percent of the energizing current, the measurement of the decay field is more accurate, since interfering fields caused by the primary electrode current in the earth are not present.

To enhance this transient pulsed current magnetic field measurement, the drill string incorporates at least two spaced, electrically isolated conductive drill string pipe sections, each separated from each other and other adjoining pipe sections by one or more electrically insulating subs. Deep well measurements are made by aligning corresponding spaced-apart wireline electrodes with the approximate centers of corresponding isolated drill pipe sections to effectively produce two drill pipe injection electrodes spaced along the drill string above the drill motor, by supplying a time-variable current to the electrodes to inject a current in the earth and producing a corresponding time-varying target current, and by detecting the resulting target magnetic field vectors at the location of a drill bit sub. Telemetry at the drill bit sub transmits the detected vector data uphole for use in calculating the distance and direction from the drill bit sub to the target.

The invention disclosed in the referenced '138 publication has proven to be very important for the drilling guidance of relief wells to intersect and to stop the uncontrolled flow of oil in a blowout well. As described above, a crucial element of that invention is to determine the direction to a "blowout" oil well from the relief well being drilled to enable proper adjustments to the direction of drilling, and this is done by orienting the electromagnetic instruments relative to the borehole using accelerometers to define the orientation of the plane defined by the direction of drilling and the direction of gravity, i.e., the vertical axis. However, when the relief well is very close to vertical and the direction of gravity almost coincides with the direction of drilling this method for tool orientation fails.

SUMMARY OF THE INVENTION

The present invention relates to an electromagnetic method and apparatus for solving the above-described problem. In addition to relief well drilling applications involving the '138 publication drilling method and apparatus, the present invention is useful whenever relative orientations must be determined remotely and where the measurements are to be made when the measuring apparatus is very close to vertical and the direction of gravity almost coincides with the direction of that apparatus.

Briefly, the present invention is directed to an electromagnetic method and apparatus for determining the azimuthal orientation of a drill bit instrumentation sub, with respect to a borehole drilling assembly, where the axis of the instrument sub coincides with the direction of drilling. In accordance with a preferred embodiment of the invention, a dipole electromagnetic field source is fastened to the drilling assembly so as to produce an auxiliary alternating electromagnetic field having a dipole axis that is perpendicular to the borehole axis. The direction of the field lines generated by this magnet is measured by electromagnetic field sensors in the drill bit instrument sub. When such a source is used, for example, in conjunction with the apparatus of the '138 publication to determine the direction from a relief borehole to a target blowout well, simultaneous measurement of an electromagnetic field generated by current flow in the blowout well casing and the direction of the auxiliary field produced by this electromagnet makes it possible to determine the direction to the blowout with reference to the direction of drilling without using an intermediate parameter such as, for example, the direction of gravity or of the Earth's magnetic field.

In accordance with a preferred embodiment of the invention, an auxiliary AC magnetic field source, such as a tiny AC solenoid, is located at or near the drilling motor, immediately above a drill bit instrument package, with the axis of the auxiliary AC field being aligned with the "tool face" bend in the drilling motor so that the field axis is perpendicular to the drilling axis. The strength of such an auxiliary electromagnetic field source can be miniscule since it is close to the electromagnetic sensors in the drill bit instrument sub. Accordingly, the electric power required is such that this field source can be powered continuously by a small battery during the entire time that the drill bit is in the borehole so the difficult problem of remotely switching it on when needed and off otherwise is eliminated. The drill bit instrument package in the instrumentation sub incorporates a sensor package including a three-component AC magnetometer for measuring the x, y and z components of the target electromagnetic field that is generated by current flow produced on a target such as a well casing of a blow-out well. These sensors also respond to the auxiliary AC field generated by the solenoid fastened to the drilling assembly near the drilling motor. The magnetic field generated by this solenoid has a different frequency than that of the low-frequency current that produces the target well field, so that signal averaging electronics in the instrument package can separate the two signals. This instrument package is programmed to accommodate the processing of the two measured electromagnetic fields of different frequencies to produce individual measurement signals which are sent up hole by an electromagnetic communication link.

The axis of the drill bit instrumentation package is aligned with the drill head and thus with the direction of drilling, and the azimuthal angle between the direction of the auxiliary field at the instrumentation package and the direction of the instrument package is known from the mechanical construction of the auxiliary field dipole source. Measurement of the target electromagnetic field gives the azimuthal direction to the target well with respect to the instrument package; however, the azimuthal direction of the drilling motor axis with respect to the target field is not precisely known, and cannot be determined by the usual gravity measurements when the borehole being drilled is nearly vertical. In accordance with the present invention, measurement of the direction of the auxiliary magnetic field at the drilling motor instrument package gives the orientation, or relative rotation angle, of the drill bit instrument sub with respect to the target magnetic field. These measured fields are then combined to determine the azimuthal angle between the direction of the drilling tool face and the target well, which is the angle required to adjust the drilling direction to intersect the target well. Although the absolute direction to the target well is not determined by these measurements, the information needed to adjust the drilling direction is.

In the preferred embodiment of the present invention, the auxiliary electromagnetic field source is made as an integral part of the drilling motor, and is located below the bend in the drill motor sub so that the axis of the auxiliary field is perpendicular to the axis of rotation of the drill face. In such a case, the dipole field normally will be mechanically aligned with the direction of the bend in the drill motor sub. However, in an alternative embodiment of the invention, the auxiliary electromagnetic source may be a separate component of the bottom hole drilling assembly, instead of being a part of the drilling motor. In this case, the auxiliary source is installed in a separate drill string sub behind (that is, above) the drilling motor sub. If such a separate drill string sub is used to carry this auxiliary source, the orientation of the dipole source with respect to the motor drill bend is not built into the motor structure, and thus the connection between the subs must be controlled so that this angle is known. In this latter case the auxiliary AC field source may be too far away from the magnetic field sensors to allow it to be continuously battery operated, so the source may be powered and controlled from a data receiving instrument package located above the drilling sub, as from a wire line system going to the surface, or from a Measurement While Drilling (MWD) instrument located in the drill string, as described in the '138 publication.

BRIEF DESCRIPTION OF THE DRAWINGS

The foregoing, and additional objects, features and advantages of the present invention will become apparent to those of skill in the art from a consideration of the following detailed description of preferred embodiments, as illustrated in the accompanying drawings, in which.

DESCRIPTION OF PREFERRED EMBODIMENTS

Figure 1:
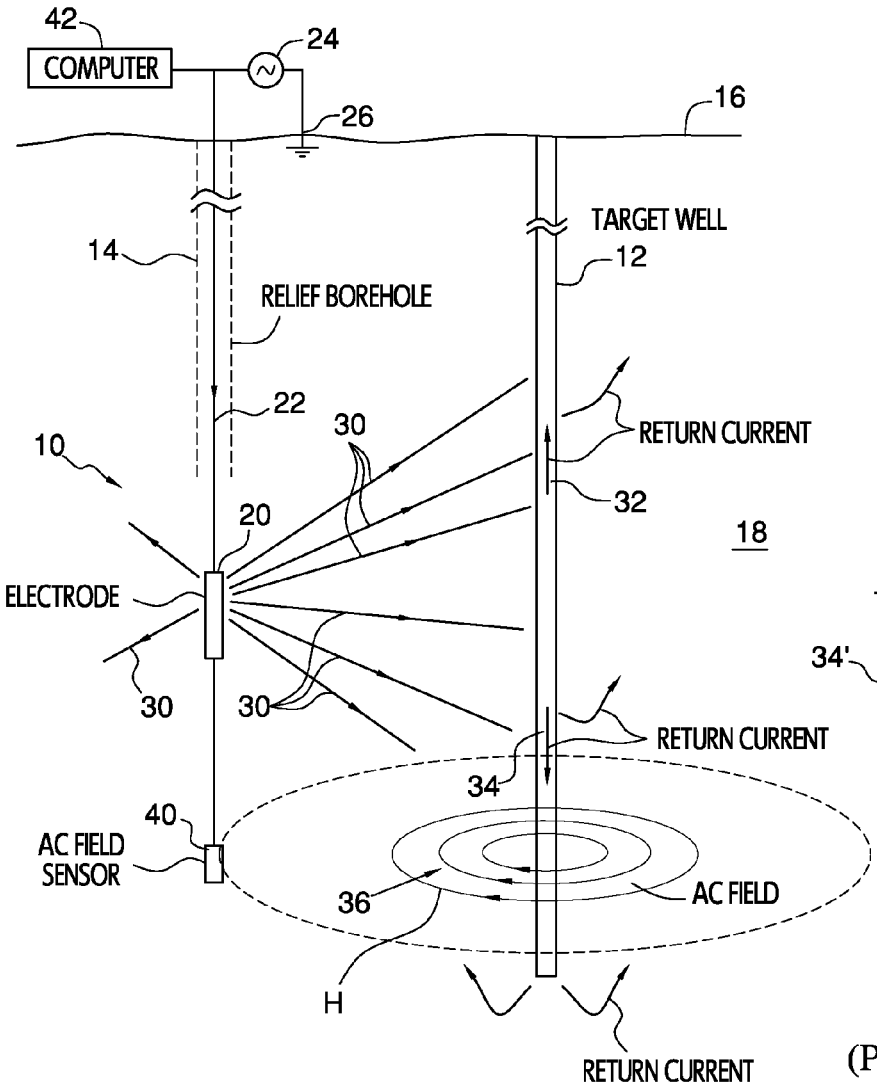
FIG. 1 (PRIOR ART)
FIG. 1 is a diagrammatic illustration of a prior art electromagnetic target location system.

FIG. 1 illustrates, in diagrammatic form, a standard well locating system 10 such as that described in U.S. Pat. No. 4,700,142, the disclosure of which is hereby incorporated herein by reference. In such a system, a target well 12 is to be intersected by drilling a relief borehole, or well, 14 along a path that will intersect the target at a desired depth below the earth's surface 16. The target well is cased, or has a drill string or other electrically conductive material in it, so that electrical current flowing in the earth's formations 18 surrounding the well 12 will tend to be concentrated on that conductive material. An alternating electrical current is injected into the earth by an electrode 20 carried by a logging cable or wireline 22, which is lowered into the relief borehole 14 after the drill string that is used to drill the relief borehole has been pulled out. The electrode is connected through wireline 22 to one side of an AC source 24, the other side of which is grounded at 26 to the earth. The electrode 20 contacts the uncased sides of the relief well so that current from source 24 is injected into the earth formations 18, as illustrated by arrows 30.

Figure 2:
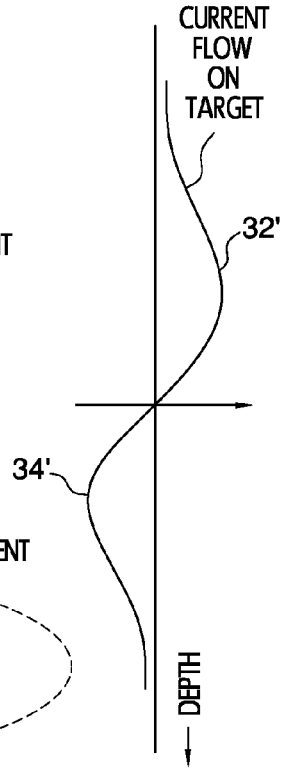
FIG. 2 (PRIOR ART)
FIG. 2 is a graph illustrating target current flow amplitude in the system of FIG. 1.

This injected current, which returns to the grounded side of the generator at 26, finds a path of least resistance through the casing or other conductive material in target well 12, producing a target current flow indicated by arrows 32 and 34, respectively, above and below the depth of the electrode 20. The upward current flow of current 32 is illustrated in FIG. 2 by curve 32', while the downward flow of target well current 34 is illustrated in FIG. 2 by curve 34'. As illustrated, at the depth of the electrode equal and opposite currents on the target produce a net zero target current, while above and below that point the target currents maximize and then decline due to leakage into the surrounding formation, as illustrated in FIG. 2, with these target well currents eventually returning to the ground point 26 through the earth.

The concentrated current flow on the target well produces, for the downward current 34, for example, a corresponding AC magnetic field 36 in the earth surrounding the target well. This target AC field is detectable by an AC field sensor, or sonde, 40 that is suspended in the relief well 14 by the wireline 22. The sonde 40, which preferably is located below the electrode 20, incorporates suitable field component detectors, such as three orthogonal magnetometers, to measure the vector components of magnetic field 36 and to produce corresponding data signals that are transmitted via the wireline to, for example, a computer 42 at the surface.

Vector signals obtained from the magnetometers in the sensor 40, together with measurements of other parameters such as the orientation of the sensor, permit calculation of the direction and distance of the target well casing from the sensor, as described, for example, in U.S. Pat. Nos. 4,700,142 or 5,512,830. In the course of drilling the relief well, the drill string is withdrawn periodically and the wireline is lowered into the relief borehole so that vector measurements and measurements of the orientation of the sensor within the borehole can be made. These measurements, together with measurements of the relief well direction made either at the same time or from previously made borehole survey data, permit a continuous calculation of the presumed location of the target well with respect to the location of the relief well. The wireline is then withdrawn and the drill reinserted into the relief well, and the calculated information is used to guide further drilling of the relief well. As the relief well approaches the desired depth, its approach to the location of the target well can be guided so that the target well is intersected at the desired depth below the earth's surface.

Such prior systems require the withdrawal of the drill string from the relief well in order to measure the target magnetic field. The system of prior publication U.S. 2010/0155138, referenced above, allows target field measurements without requiring the withdrawal of the relief drill string, and is illustrated at 50 in FIG. 3, to which reference is now made. In this system, a relief borehole, or well, 52, which is illustrated in dashed lines, is produced by a drill carried by a drill string 54 which, in conventional manner, is suspended from a surface drilling rig (not shown). Such a drill string typically consists of multiple drill string sections of steel pipe, such as the illustrated sections 56, 57, 58 . . . 59, each normally about ten meters in length and coupled together end-to-end at threaded joints. In a conventional manner, the bottom, or distal end, of the drill string incorporates a standard hydraulic drilling motor 62 in a bent housing 64, with the motor having a rotating drive shaft 66 connected to a drill bit 68. The drill bit carries a drill bit instrument sub 70 which is secured to and rotates with the drill bit. Located in the drill string 54 just above the drilling motor housing 64 is a conventional measurement-while-drilling (MWD) measurement system for producing a log of the drilling and for use in controlling the direction of drilling.

Figure 3:
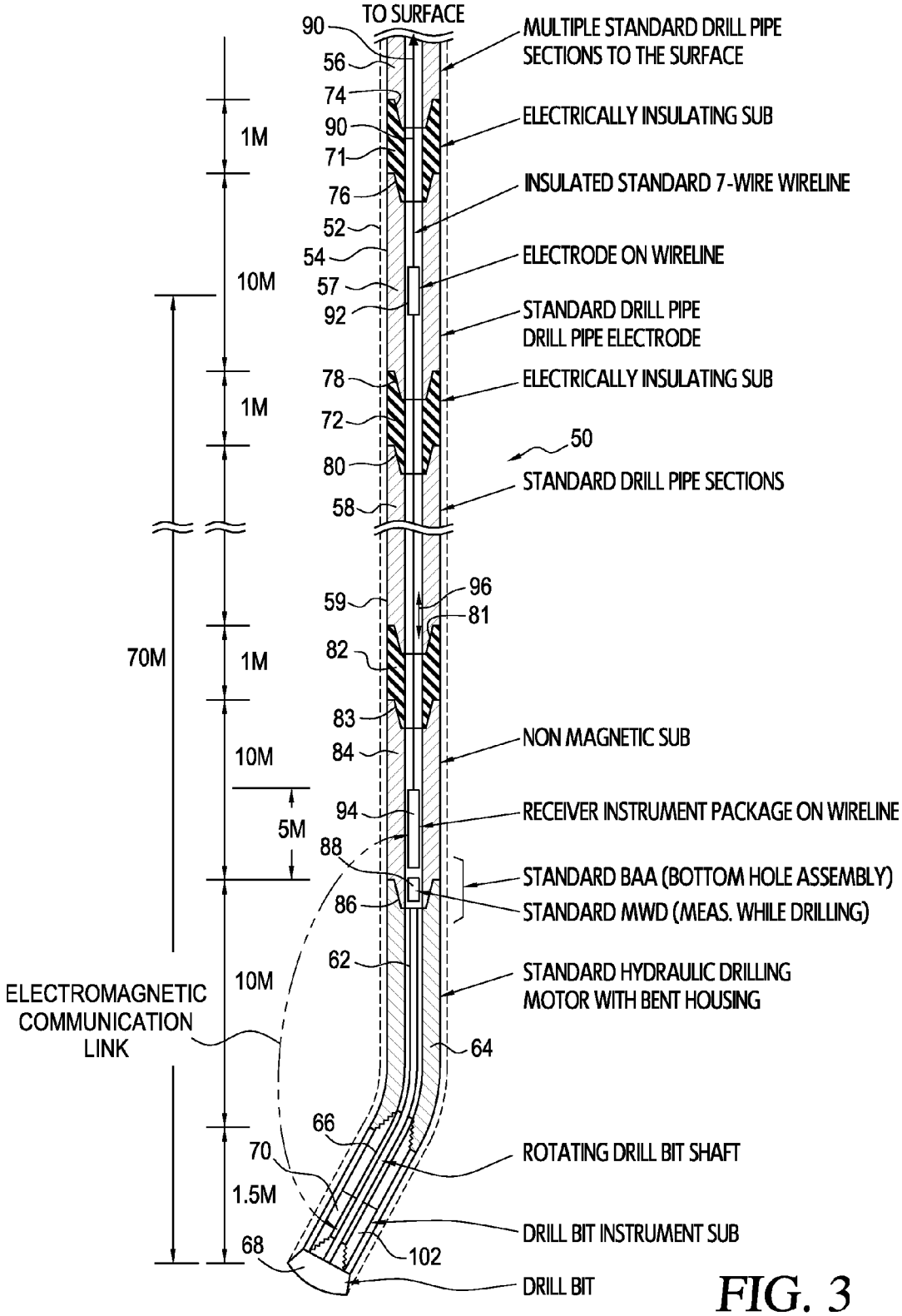
FIG. 3 (PRIOR ART)
FIG. 3 is a diagrammatic illustration of the prior wire line electrode system described in U.S. Published Application No. 2010/0155138.

At least one of the electrically conductive drill pipe sections; for example section 57, is electrically isolated from adjacent drill pipe sections to form a pipe electrode for use in injecting current into the surrounding earth formations. This pipe electrode 57 is formed by inserting one or more electrically insulating subs 71 and 72, which may be short insulating pipe sections about one meter in length, in the drill string above and below the drill pipe section 57 that is to be isolated, as illustrated in FIG. 3. The insulating sub 71 is threaded to the bottom of standard steel pipe section 56 at threaded joint 74, and to the top of standard steel pipe section 57, at threaded joint 76, to space and electrically insulate the adjacent pipe sections 56 and 57 from each other. The second insulating sub 72 is threaded to the bottom of the steel drill pipe section 57 at threaded joint 78 and to the top of the next adjacent steel drill pipe section 58 at threaded joint 80. Sub 72 separates, and electrically insulates, adjacent steel pipe sections 57 and 58 from each other, thereby electrically isolating pipe electrode section 57 from the remainder of the drill string.

Connected below the isolated drill pipe electrode section 57 are one or more additional steel drill pipe sections such as sections 58 . . . 59, the number of drill pipe sections being selected to position the electrode section 57 at a desired distance above the drill bit. A suitable distance between the pipe electrode section 57 and the drill bit 68 may be about 70 meters.

The lowermost end of the bottom drill pipe 59 is connected at a threaded joint 81 through an electrically insulating sub 82 and a threaded joint 83 to a nonmagnetic drill pipe section 84, the lower end of which is connected at threaded joint 86 to the top of drilling motor bent housing 64. A standard MWD instrument in an MWD housing 88 is located within the nonmagnetic pipe section 84 to allow the MWD equipment to detect surrounding magnetic fields during drilling and to space the drill pipe electrode 57 at the desired distance above the drill bit instrument sub 70.

Located within the drill string 54 is a wireline 90, which is suspended from the earth's surface at the drill rig. During pauses in the drilling operation, the wireline is lowered into the relief well down through the central, axially-extending opening of the drill string. The drilling fluid flows through this axial opening to drive the motor 64, so the opening effectively terminates at the top of the motor. The wireline incorporates both power cables for injecting AC current into the earth and data cables for connecting down-hole instruments with the surface, and is covered by an insulating material such as an electrically insulating layer of a plastic such as HYTREL for protection from the harsh environment. The power cable in the wireline is connected to an electrode 92 which is uninsulated and is located on the wireline for electrical communication with the interior of the isolated drill pipe section 57. This electrode may physically contact the interior of section 57 by way of spring-loaded contacts, or a good electrical connection can be made through the drilling fluid, or drilling mud, if it is electrically conductive, since this fluid remains within the drill string during this process. Electrode 92 is accurately located centrally along the length of the drill string electrode section 57 simply by measuring the depth of the drill string.

The data cable in the wireline is connected to an instrument package 94 that is secured to the distal end of the wireline, below the electrode 92, with the wireline being long enough to locate this package centrally within the nonmagnetic sub 84. The power cable in the wireline is connected at the surface to a suitable source 24 (FIG. 1) of a periodically varying current such as a low-frequency AC to produce alternating current 96 in the cable, while the data cable is connected to suitable control circuitry at the surface, such as a computer 42 (FIG. 1).

Figure 4:
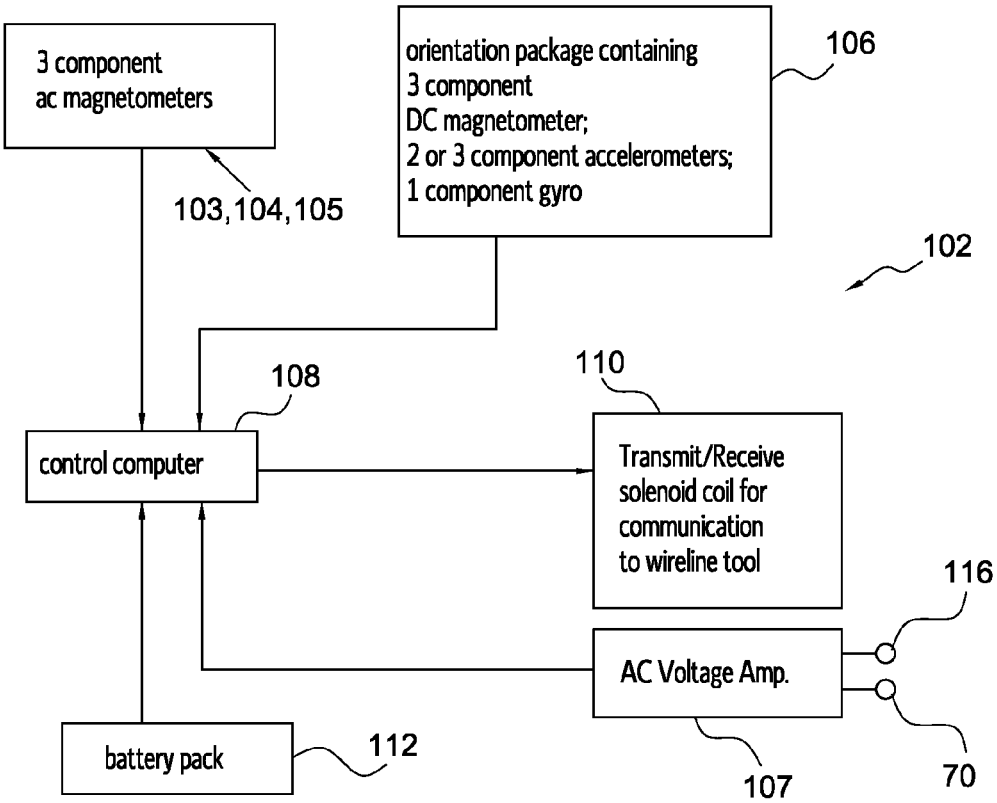
FIG. 4 is a circuit diagram of sensor circuitry for the system of FIG. 3.

Magnetic field and other sensors are provided in a drill bit sensor instrument package 102 mounted on the drill bit sub 70. The instrument 102 is illustrated in FIG. 4 as incorporating a three-component AC magnetometer including magnetometers 103, 104 and 105 for measuring x, y and z vector components, respectively, of the varying electromagnetic field H that is generated by current flow on a target such as a well casing (see FIG. 1). These magnetometer components may be constructed using coils surrounding U-shaped cores in accordance with the teachings of U.S. Pat. No. 4,502,010, for example. The instrument 102 also contains an orientation package 106 for determining the orientation of the AC magnetometers, and thus may contain two-component or three-component accelerometers, a one-component gyroscope and a 3-component earth field DC magnetometer for detecting vector components of the apparent Earth's field. Apparent Earth field measurements can also be used to determine the static magnetic field generated by the target well and thus the relative location of the target well using well known methods of static field analysis.

The drill bit instrument sub 102 also has an AC voltage detector 107 to measure the polarity and magnitude of the electric field in the nearby Earth and thus to provide a direct measurement of the sense of the AC current flow on the target well relative to the AC magnetic fields Hx1, Hx2, Hy1, Hy2, and Hz. With a symmetric AC current waveform on the target well there may be some ambiguity in the sense of the current flow which is removed by this measurement. This sign ambiguity can also be determined by including an even time harmonic component to the AC current injected into the formations. In many cases this ambiguity also can be removed by well known, indirect means such as by noting the character of measurements at other nearby depths.

The magnetometer components, the orientation package, and the AC amplifier are connected to a down-hole control computer 108 in the instrument 102 for preliminary processing of received data and the computer is, in turn, connected to a communications solenoid coil 110 for wirelessly transmitting data to the wireline instrument package 94. Although such solenoids have a limited communication range when used underground, sufficient power is provided by a battery pack 112 to provide reliable data communication between the drill sub instrument 102 and the wireline instrument 94, which is normally less than about 30 meters distant. In order to preserve power, the computer 108 contains control circuitry that responds to the presence of output signals from the magnetometers in response to magnetic fields generated in the target, to turn the instrument off when it is not being used, and on when field measurements are to be made.

Figure 5:
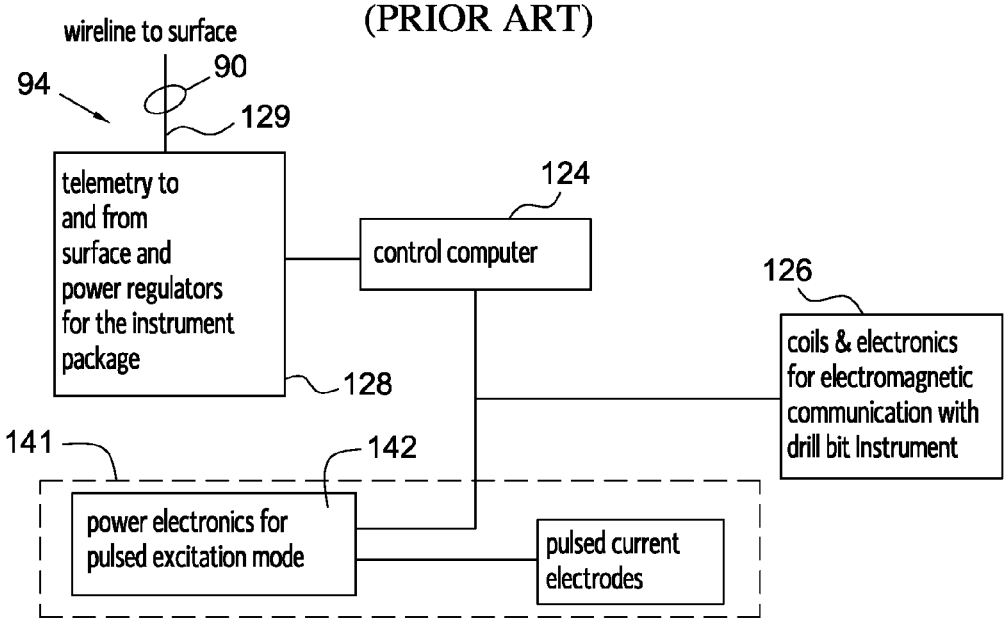
FIG. 5 is a circuit diagram of a wireline instrument package for the system of FIG. 3.

The main wireline instrument package 94, illustrated in FIG. 5, is carried at the end of the wireline 90, and incorporates a control computer 124 connected to a suitable electromagnetic communication circuit 126, which may be a solenoid, for receiving data from the drill bit instrument 102, and for controlling the operation of instrument 102. This computer 124 also is connected to computer 42 at the surface through telemetry 128 and a data cable 129 carried by wireline 90.

Drilling of a relief borehole is carried out, for the most part, in the known manner illustrated in FIG. 1, but using the drill string structure described with respect to FIGS. 3-5. Drilling fluid flows down through the center of the drill string 50 to provide driving power for the hydraulic drilling motor 62, and the direction of drilling is controlled by turning the drill string so that the borehole will be drilled in the direction faced by the bent housing and the drill bit. The drill bit instrument 102 in sub 70 rotates with the drill bit, but is turned off during drilling, while the MWD system 88 controls the drilling operation in known manner.

In order to precisely measure the distance and direction from the drill bit to the target to permit accurate guidance of further drilling, the drilling is stopped, and the wireline 90, with at least the first electrode 92 and with its instrument package 94, is lowered down the center of the drill string. If necessary, the drilling fluid can be pumped to assist in carrying the wireline down the drill string. The instrument 94 is lowered into the nonmagnetic sub 84 so that the wireline electrode 92 is positioned in its corresponding drill pipe electrode section 57. The electrodes are in effective electrical contact with each other, so that when power is supplied from source 24, the drill pipe section 57 acts as an injection electrode for injecting electrical current into the earth surrounding the borehole. Although the power supply is preferably a low-frequency AC source, as described above, a DC source may be used if desired, with down hole switching providing alternating or pulsed current to the surrounding earth formations. The pipe section 57 produces current flow in the earth by contacting the earth directly or through the drilling fluid that flows up-hole around the outside of the drill string from the region of the drill bit to the surface.

After the wireline 90 is positioned in the drill string, electrode 92 is energized to inject several amperes of current having, for example, a frequency of about 1 to 20 Hertz, into the earth formation 18 surrounding the target well 12 and the relief well 52. As in the prior art described with respect to FIGS. 1 and 2, the injected current flows through the earth to eventually return to the ground point 26, with part of this alternating current flowing through the conductive path of least resistance in target well 12. The target current has the amplitude vs. depth characteristic illustrated by FIG. 2, with the maximum current on the target occurring at a depth that is approximately midway between the electrode 92 and the earth's surface, and at a similar distance below the level of the electrode. The current produces a corresponding target magnetic field around target well 12, as was described with respect to FIG. 1, which field is detectable by the drill bit instrument 102. At the drill bit, target field vectors and other measurements are processed and transmitted electromagnetically to the wireline instrument package 94 for retransmission to the computer 42 at the earth's surface. Since this target field is measured at the drill bit, the calculations made by computer 42 of the distance and direction from the bit to the target are more accurate than would be possible at the depth of the wireline instrument package 94 or with measurements made at the conventional MWD instrument located above the motor 62.

Although the foregoing apparatus generally works well, it has been found that a problem occurs when the relief well is very close to vertical and the direction of gravity almost coincides with the direction of drilling; in such cases, the above-described prior method for tool orientation fails. However, this difficulty is overcome in accordance with the present invention by an auxiliary electromagnetic apparatus and an accompanying method for determining the azimuthal orientation of the drill bit instrumentation sub with respect to the borehole bottom drilling assembly even when the well being drilled is nearly vertical.

Figure 16:
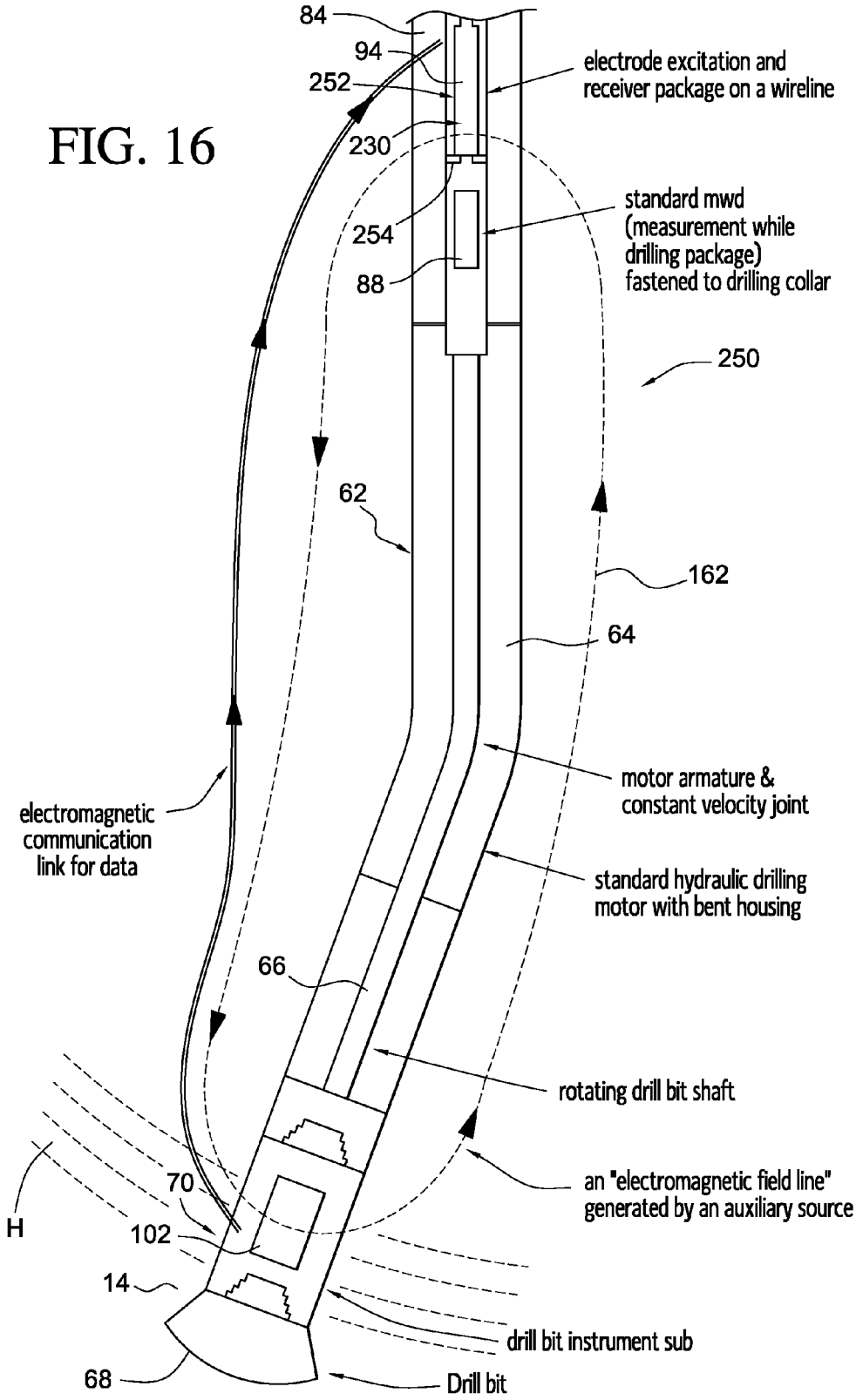
FIG. 16 is a diagrammatic illustration showing an alternating magnetic field source which is an integral part of an MWD system.
Figure 17:
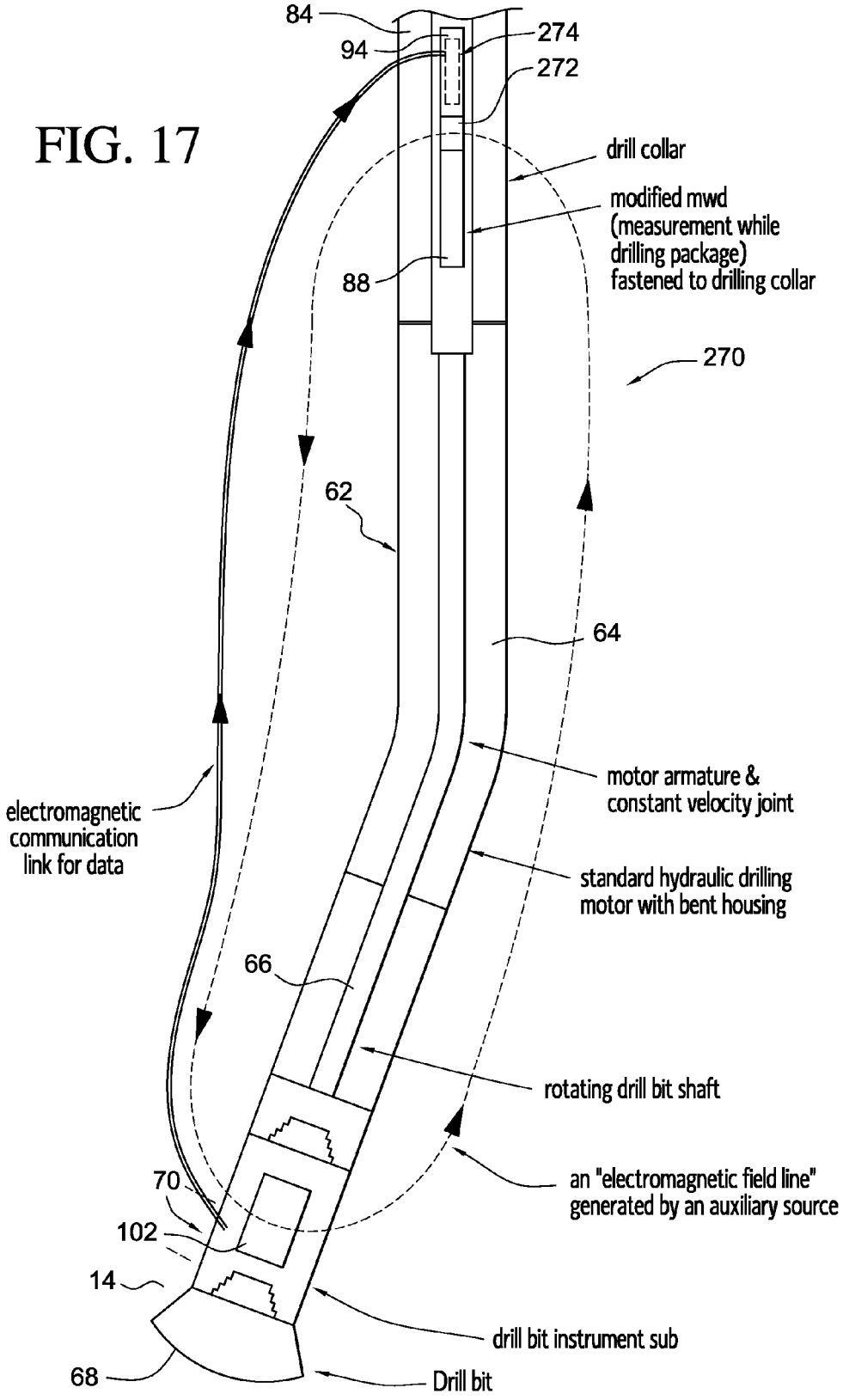
FIG. 17 Is a diagrammatic illustration showing an alternating magnetic field source which is an integral part of a wire line receiver unit which is set into an orienting plate which is part of the drill string.

It must be understood that the use of a down-hole drilling motor 62 having a bent housing sub 64 will cause the drill bit 68 to have a rotational axis that is a few degrees different from the main borehole axis so that the drilling motor housing enables drilling either a curved hole or a hole which, on average, is straight. If there is no rotation of the motor housing 64 or of the drill stem to which it is connected, i.e., it is allowed to "slide" while the drill bit rotation is powered by fluid flow through the motor, the misalignment of the drill bit drilling axis from the main motor housing axis; i.e., the bend in the drill motor housing, results in the new borehole direction deviating from that of the borehole in which the motor is located. As a result, a curved borehole is produced in the direction of the bend; typically the change in drilling direction can be a few degrees or more per hundred feet of drilling. If the motor housing 64 is rotated at the same time as the drill bit 68 is powered by drilling fluid flow through the motor 62, a "spirally" drilled borehole results, which on the average is straight. Thus, by alternately "sliding" the motor housing and rotating it a borehole of controlled curvature and corrected drilling direction can be achieved. The misalignment of the drill bit axis of drilling and the axis of the motor is facilitated by an elbow having a constant velocity joint in the bent motor housing 64, as is illustrated in FIGS. 16 and 17, for example.

Figure 6:
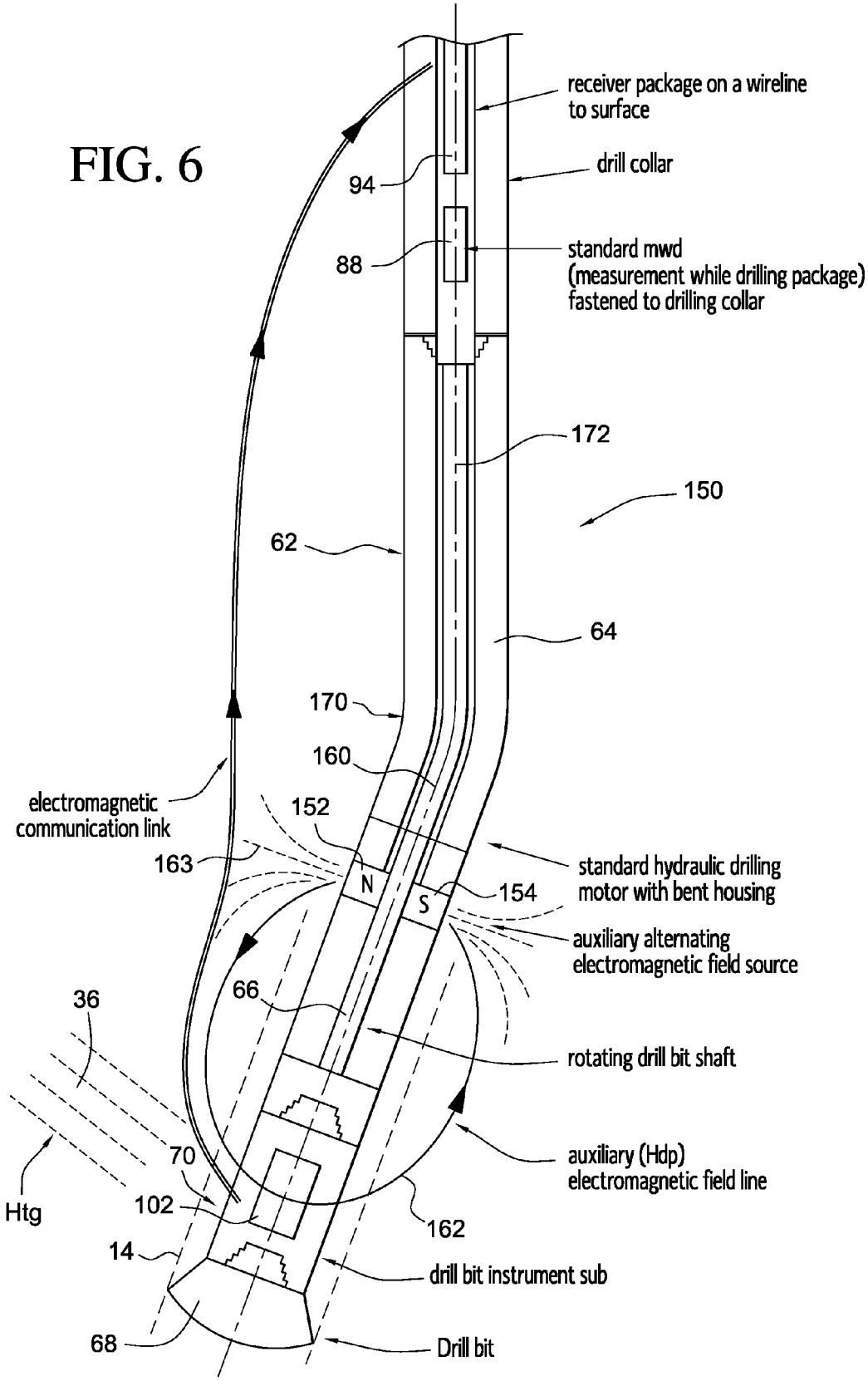
FIG. 6 is a diagrammatic illustration of the orientation system of the present invention, having an auxiliary alternating magnetic field source mounted on a drill motor housing near a drill bit instrument.

One embodiment of the invention is illustrated diagrammatically at 150 in FIG. 6, wherein components similar to the illustrations of FIGS. 1-3 are similarly numbered. In this figure, only the borehole bottom portion of the drilling assembly of FIG. 3 is illustrated for convenience. In the illustrated embodiment, an auxiliary dipole electromagnet 152 is fastened to the drilling assembly, for example to the bottom, or distal end 154, of the bent housing 64 of the drilling motor 62. The electromagnet is mounted to be perpendicular to the longitudinal axis 160 of the lower portion of the bent housing and of the drill head 68 so as to produce an auxiliary alternating electromagnetic field 162 having its axis 163 also perpendicular to axis 160 and thus perpendicular to the axis of the relief borehole 14 being drilled when the bent housing is in the "sliding" mode. As illustrated, the dipole source is located below the bend, or elbow 170 in the bent housing 64, so that axis 160 is the axis of the lower portion of the housing. As is known, the bent sub or housing 64 incorporates a constant velocity joint in the motor to enable fluid flow through the motor to drive the drill head.

The direction of the field lines of the field 162 generated by the auxiliary field source magnet 152 is measured by the electromagnetic field sensors 103, 104 and 105 in the instrument package 102 (FIG. 4) that is carried by the drill bit sub 70 to determine the angular orientation of the lower part of the drill housing with respect to the measured target field. Simultaneous measurements of this auxiliary field and of the target electromagnetic field then make it possible to determine the direction to the blowout with reference to the drilling assembly without using an intermediate parameter such as, for example, the direction of gravity when the drill assembly is near the vertical. Since the rotational, or angular orientation of the motor housing 64 controls the direction of the drilling direction, comparing the direction of the auxiliary field 162 produced by electromagnet 152 with that of the target field 36 generated by current flow in the target well 12 makes it possible optimally to rotationally orient the drilling assembly to achieve the corrective action desired. This principle can be used whether the corrective drilling direction is controlled by the orientation of a bent motor housing or, in the case of rotary steerable drilling, the bending of the drill string itself. In the latter case the electromagnet 152 would be mounted on the mechanism controlling the drill stem bend. Although the application of the present invention to bent motor housing drilling is illustrated herein, applying the same principles to rotary steerable drilling thus will be apparent to those skilled in the art.

Figure 7:
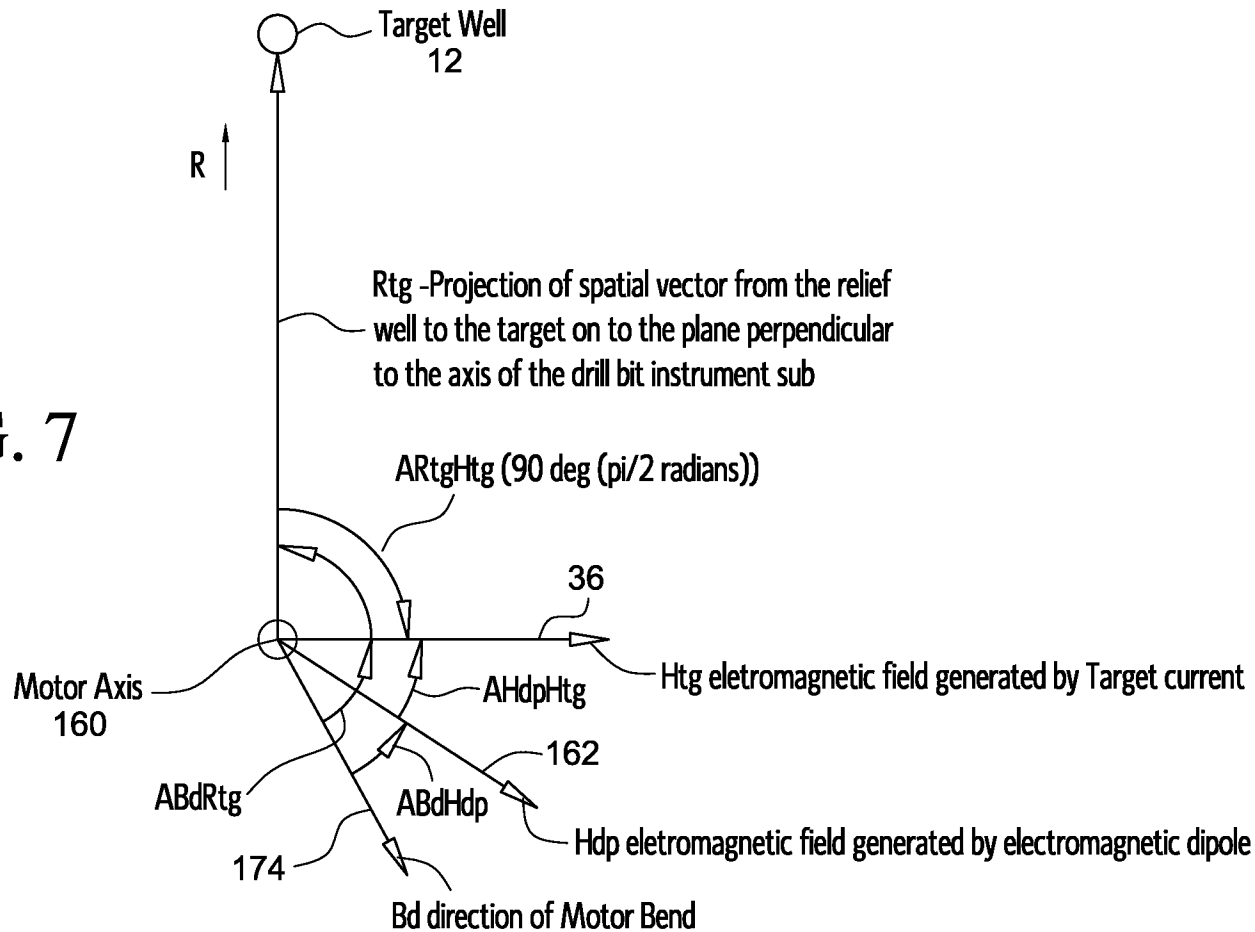
FIG. 7 is a diagrammatic illustration of an end view of the relationship of target and auxiliary magnetic fields.

As illustrated in FIGS. 6 and 7, the electromagnet 152 adds the auxiliary alternating dipole magnetic field 162 (Hdp) to the target electromagnetic field Htg (field 36 in FIG. 1) produced by the target current flow at the drill bit sub 70 at the lower end of the drilling motor 62. As described above, the drill bit sub carries the drill bit instrument 102 (FIG. 4), where AC magnetic field sensors 103, 104 and 105 measure the components Hx1, Hy1, Hx2, Hy2, Hz1 and Hz2, respectively, of the electromagnetic fields at that location. The first four measurements are the important components for the present consideration. Thus, these sensors respond to the AC magnetic fields in their vicinity, i.e., the target fields generated by the target well 12 at a first frequency, and the auxiliary fields generated at a second frequency by the dipole source 152 at the lower end of the drill motor, the different frequencies allowing the field measurements to be distinguished from each other. FIG. 6 shows the electromagnet 152 as having N and S poles to depict the direction of the dipole field axis 163; however, it will be understood that the illustrated NS pole orientation is an instantaneous value, the N and S poles alternating because of the alternating current powering the dipole source 152.

To consider the physical principles of the method and apparatus of this invention, reference is made to FIG. 7, which illustrates a view looking down the relief well axis 160 in the vicinity of the target borehole 12. Since the bend 170 in the motor is just a few degrees, any difference in the electromagnetic field directions with respect to the relief well axis shown at 172 in FIG. 6 and the instantaneous drilling axis 160 of the drill 68 can be neglected. As Illustrated in FIG. 7, ARtgHtg is the angle between the projection Rtg of the radius vector R to the target 12 on this view and the projection Htg of field 36 generated by target currents, and is 90 degrees. The projection of field 162 (Hdp) generated by the dipole source 152 is also shown in FIG. 7. Since the dipole source 152 is fixed to the lower end of the bent housing in one embodiment of the invention, or is located in a separate sub above, and having a known angular relationship to, the motor sub in another embodiment, the angular direction Bd of the drill stem bend 170 with respect to the dipole source 152 is known, and accordingly the direction of the sensors 102 is also known. The relative direction of the sensors is represented by vector 174 in FIG. 7, and the angle ABdHdp is known by mechanical construction parameters. The directions of both auxiliary field 162 (Hdp) and target field 36 (HTg) can be measured using the same electromagnetic field sensors 102, as noted above. As illustrated in FIG. 7, the angle ABdRtg between the direction 174 of the drill motor bend and the direction Rtg to the target 12 is given by:

$$ABdRtg=ABdHdp+AHdpHtg+pi/2 \quad \text{(Eq. 1)}$$

Thus, the direction of drilling direction correction to be made, ABdRtg, to cause the drill to intersect the target well 12 is determined directly from the measurements of the target field, the auxiliary field and the known angle between the axis of the auxiliary field source and the actual direction of the bent drill housing, without the need for additional orientation measurements such as the direction of the Earth's field or Gravity.

The field source 152 in FIG. 6 is shown as being on the lower part of the drilling motor bent sub 64, below the "tool face" bend 170 in the housing so that its axis is perpendicular to the tool face; i.e., to the face of the drill bit 64. Since the bend 170 is typically small, the axis 163 of the field source is not only perpendicular to the bent housing axis 160, but may be considered to be substantially perpendicular to the direction of drilling represented by axis 172. The angle ABdHdp between the direction (Bd) of bend 170, represented by vector 174, that produces the direction of drilling by the motor, and the direction 162 of the dipole 152 and its field Hdp is arbitrary, but must be known.

The configuration of FIG. 6 shows the electromagnetic dipole source 152 as being very close to the drill bit sensors 102, and this minimizes the battery power needed to energize the dipole field source. The target-generated magnetic field 36 (Htg) and the dipole source field 162 (Hdp) have different frequencies of excitation, in accordance with the invention, so that the signal averaging electronics in the computer 108 in the drill bit instrumentation sub 102 is capable of separating the two signals. To do this requires readily available software embedded in the computer 108 in drill bit instrument sub 102.

Measurement of the target electromagnetic field 36 (Htg) gives the azimuthal angle ARtgHtg of the direction to the target well from the drill bit instrument sensors 102, which is 90 degrees, while measurement of the direction of the auxiliary magnetic field 162 (Hdp) from the drilling motor gives the relative azimuthal angle AHdpHtg of the vector of field 162 (Hdp) with respect to the target well field 36 The orientation 174 of the sensors and thus of the drill bit instrument sub is indicated by angle ABdHdp, and is known from the mechanical construction of the auxiliary source. As shown above, the sum of these angles gives the azimuthal angle (ABdRtg) between the direction 174 of the tool face (i.e., the face of the drill bit 68) and the direction of source 12 of the target field Htg, and thus provides the relative orientation of the bent housing of the motor, which controls the direction of drilling, and the drill bit sub, this difference being the change of direction required to adjust the drilling direction.

Figure 8:
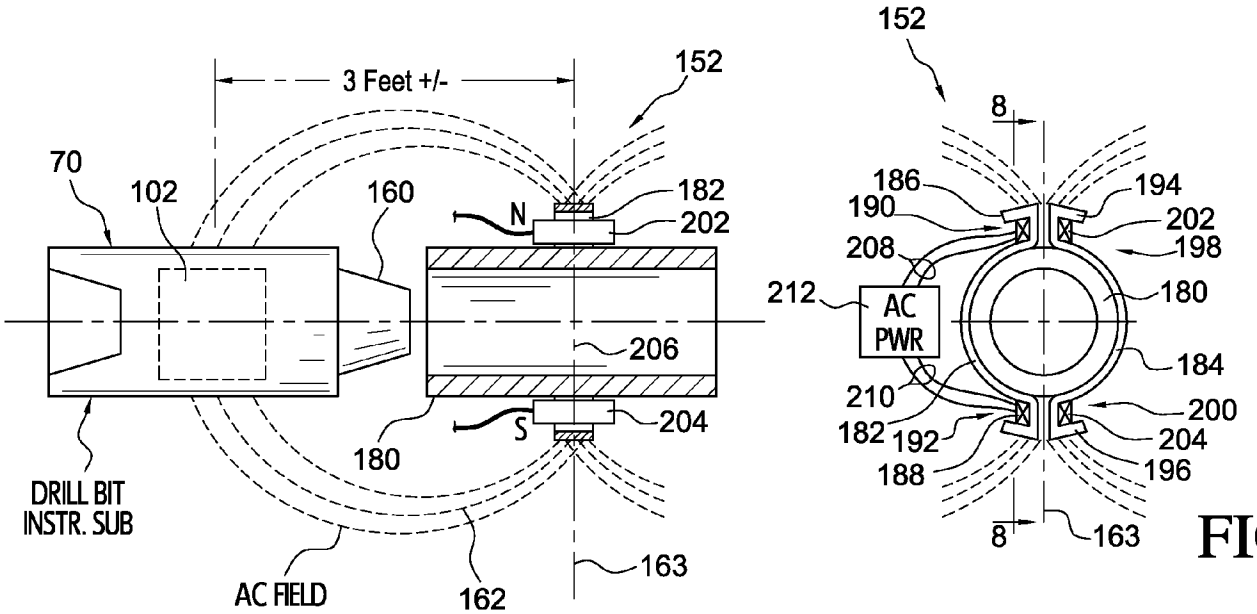
FIG. 8 is a diagrammatic illustration in partial cross-section taken along line 8-8 of FIG. 9, showing the auxiliary alternating magnetic field source of the present invention mounted on a simulated drill motor housing as part of a test setup to evaluate the feasibility of the present invention.
Figure 9:
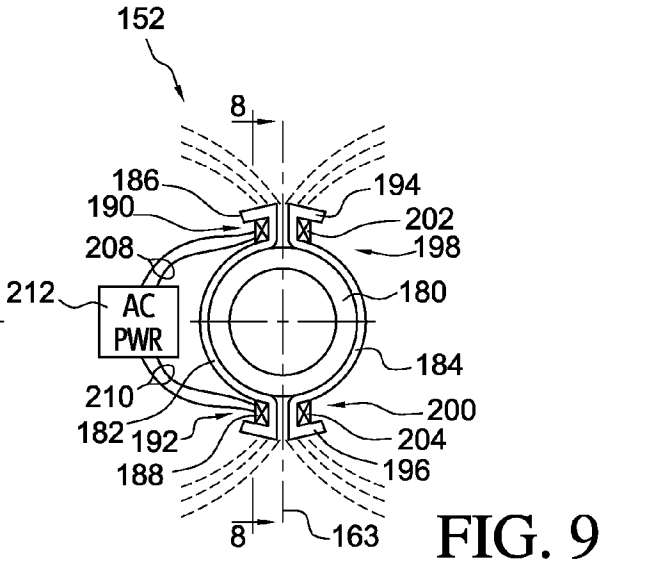
FIG. 9 is an end view of the apparatus of FIG. 8.

To demonstrate the efficacy of the apparatus shown in FIG. 6 in carrying out the method of the present invention, a test apparatus, illustrated in FIGS. 8 and 9, was assembled. It consisted of the drill bit instrument sub 70 described above as incorporating the instrument package 102 illustrated in FIG. 4. A short length of 5 inch diameter steel pipe 180 was used to simulate the presence of the steel at the lower end 154 of drilling motor bent housing 64. The auxiliary electromagnetic field source 152 consisted of two thin mu metal strips 182 and 184, each of which was ⅜" wide, wrapped around opposite sides of the pipe 180. The strips 182 and 184 were each constructed with outwardly facing flanges on each end, upper and lower flanges 186 and 188 on strip 182 to form outwardly facing cavities 190 and 192, and flanges 194 and 196 on strip 184, to form outwardly facing cavities 198 and 200. The upper and lower cavities were secured back-to-back, on opposite sides of the steel pipe, to form pole pieces for the electromagnetic source 152 and to provide bobbins for receiving upper and lower coils 202 and 204. The axis 206 of the source 152 is perpendicular to the axis 160 of the simulated drill motor housing 180. In an actual application the pole pieces would be flush with the drilling motor housing.

Figure 10:
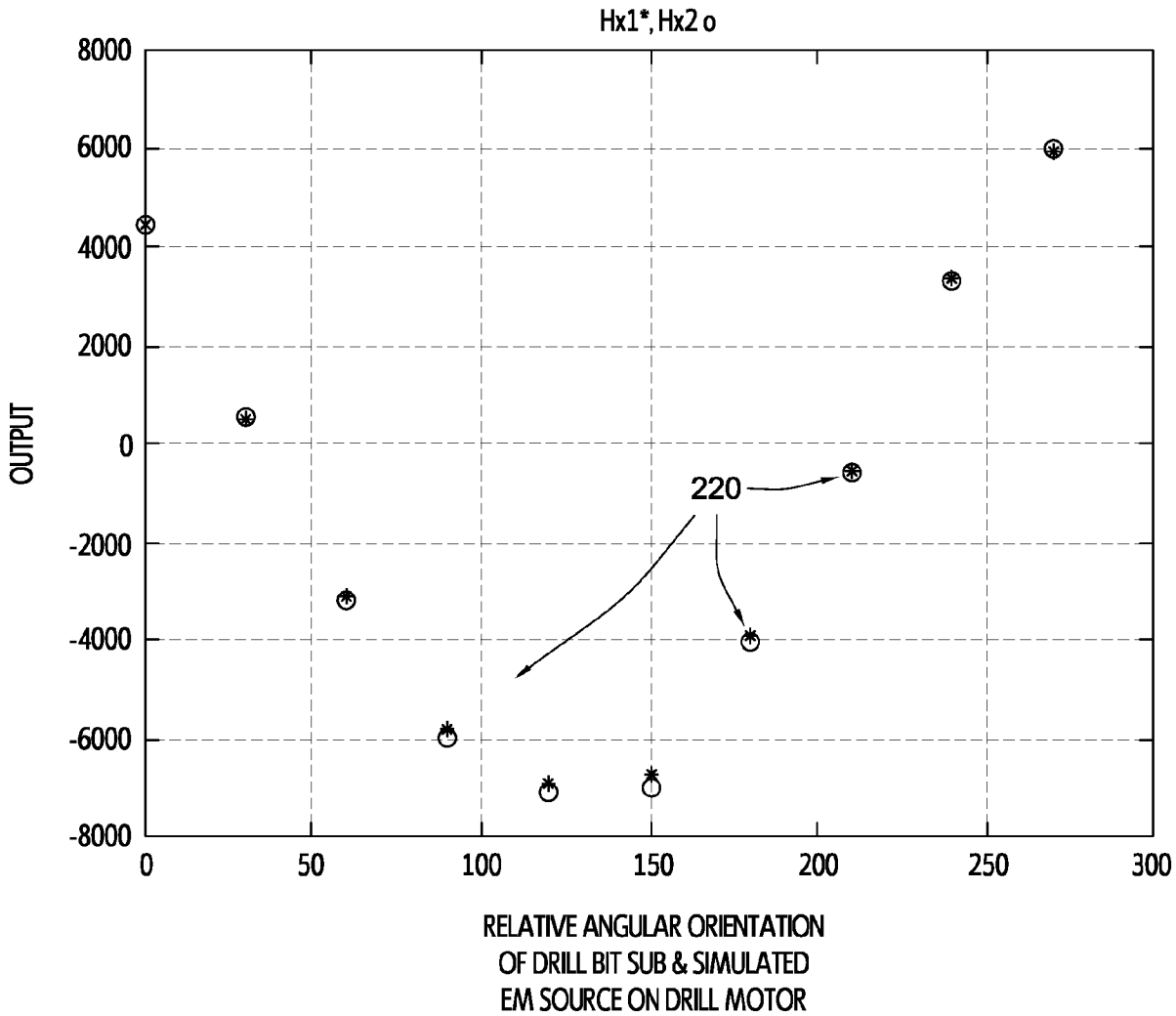
FIG. 10 is a graph of Hx1 and Hx2 signals recorded by a drill bit instrument sub as it is rotated with respect to the auxiliary alternating magnetic field source of FIG. 8.
Figure 11:
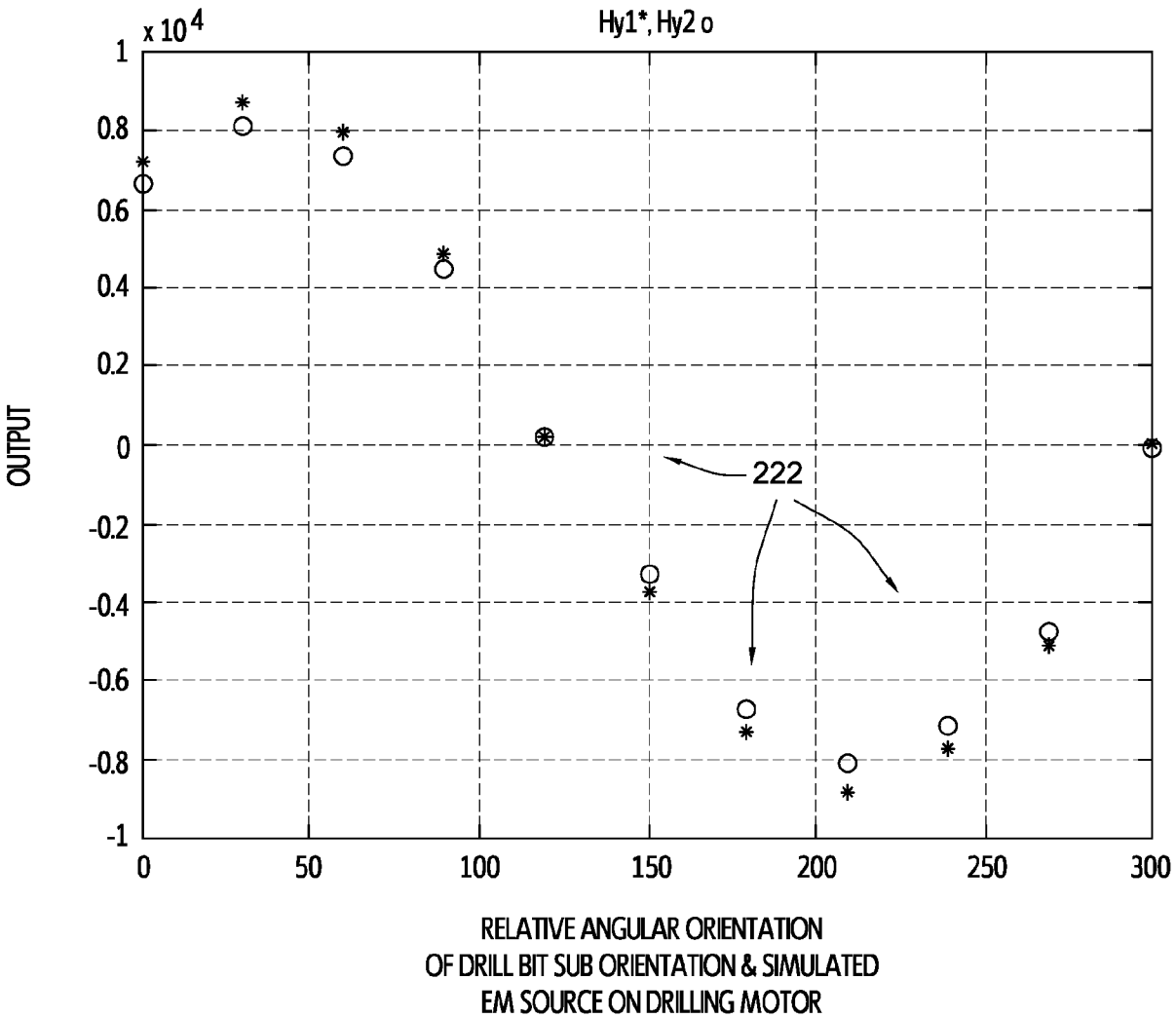
FIG. 11 is a graph of the Hy1 and Hy2 signals recorded by a drill bit instrument sub as it is rotated with respect to the auxiliary alternating magnetic field source of FIG. 8.

The coils 202 and 204 each had about 10,000 turns of #40 wire and were connected via leads 208 and 210, respectively, to a strongly attenuated output from a power supply 212 of the type normally used to excite electrode current for relief well work. About 600 micro amperes of current at about 3 volts at a frequency of 15 Hertz powered the coils. The x and y components of the resulting field 162 were measured at the sub 70 by the x and y magnetometers 103 and 104, which produced corresponding output signals Hx1, Hx2, and Hy1, Hy2 as the instrument was rolled about its axis. These outputs are illustrated by the measurement points indicated at 220 and 222 in FIGS. 10 and 11, respectively. The magnetometers 103 and 104, and thus the Hx and Hy signals 220 and 222, are in quadrature with each other and the signals had a large amplitude, about 100 times the background fluctuations. When this electromagnetic source 152 is mounted on a drilling motor bent sub 64, the rotational angle between the drill sub 70 and the magnetic axis of the source on the lower part of the drilling motor housing can be found from these data through the use of the 4 quadrant arc tangent function, i.e., the angle given by the relation a tan 2 ((Hy1+Hy2), (Hx1+Hx2)).

Figure 13:
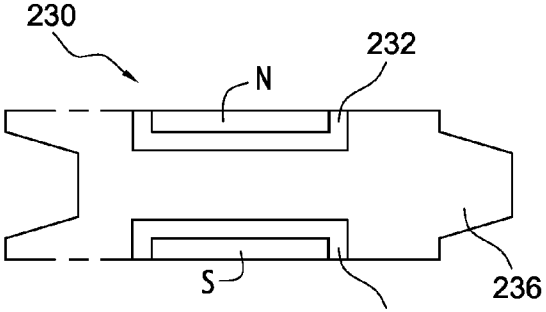
FIGS. 12-14 illustrate top, side and end views of a standalone drill string sub which incorporates an alternating magnetic field source for orienting a drill bit instrument sub in accordance with another embodiment of the invention.
Figure 14:
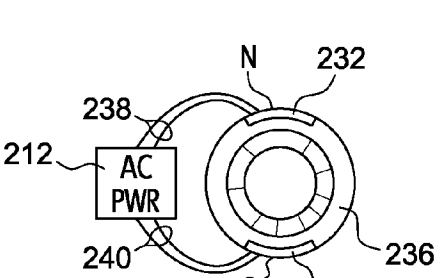
Figure 12:
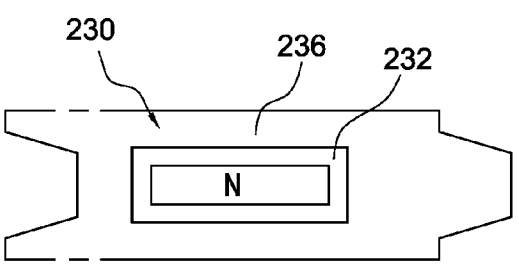
Figure 15:
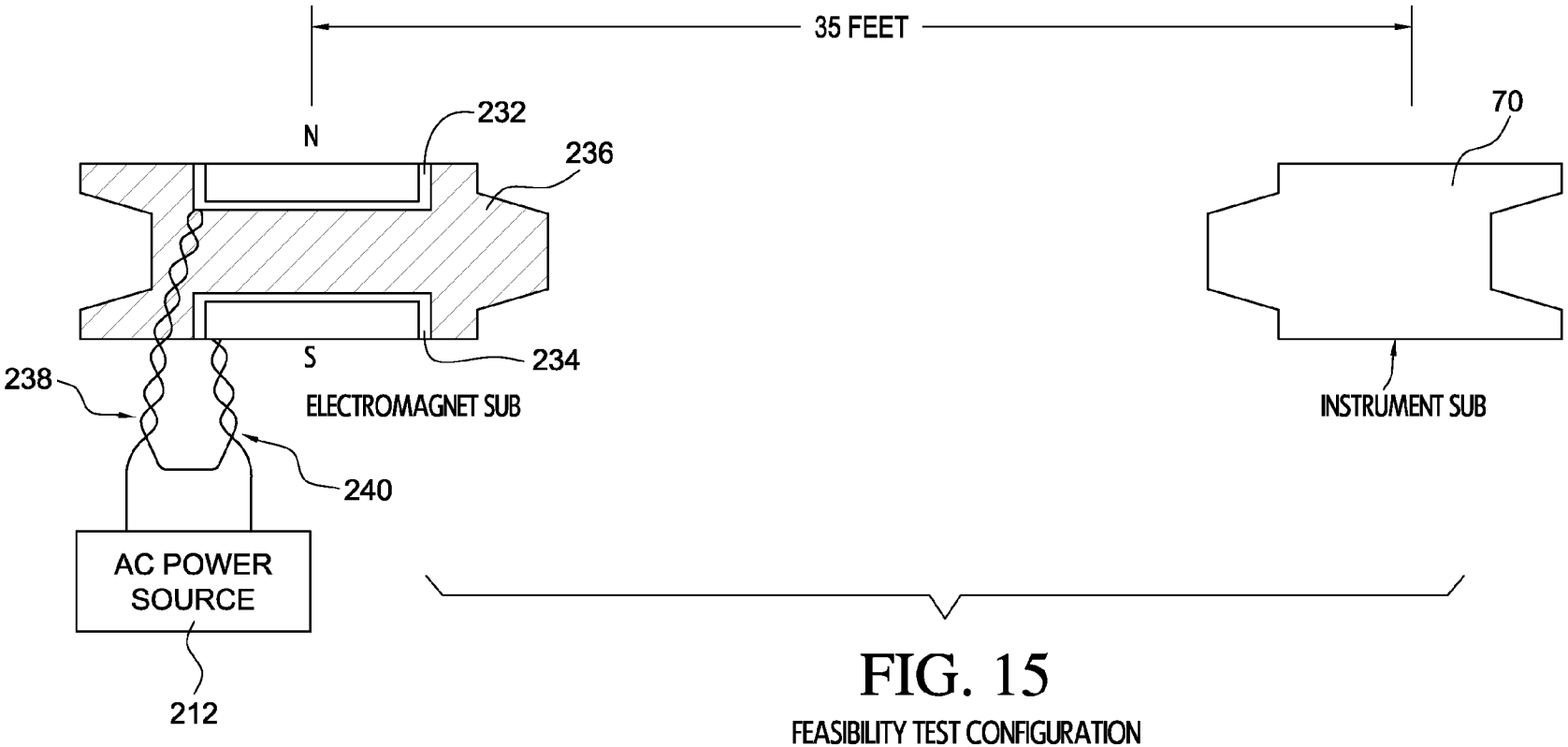
FIG. 15 is a diagrammatic illustration of the relative separation of a standalone alternating magnetic field source mounted directly above a representative drilling motor and a drill bit instrument which is mounted on the rotating shaft of the drilling motor.

An alternative apparatus is illustrated in FIGS. 12-14, wherein a suitable electromagnetic magnetic dipole source 230 consisting of coils 232 and 234 is mounted on a drill string sub 236. This sub 236 is independent of the bent housing of the drilling motor, and may be incorporated in the drill string 50 at a suitable location above (uphole of) the bent sub 64. As illustrated in FIG. 15, the coils 232 and 234 in sub 236 are connected to the AC source 212 via leads 238 and 240. Tests indicated that 3 amperes of current from the source to the coils is sufficient to give a signal of acceptable strength at the sensor instrument package 102 in sub 70 at a distance of 35 feet away. This is a representative configuration with this dipole source sub 236 mounted directly above the drilling motor. The power required can be supplied by a battery of modest size. The use of such an electromagnetic source in an independent sub, instead of being mounted on the bent housing of the drilling motor, increases its versatility, making it useful in both a wire line system and as a part of an MWD version of the invention, to be described below.

As discussed above, in one form of the invention the electromagnetic field detection system is incorporated in a drill string having a receiver instrument package 94 carried by a wireline 90 (FIG. 3). In accordance with another embodiment of the present invention, the independent sub 236 discussed with respect to FIGS. 12-15 may be the nonmagnetic sub 84 of such a drill string, illustrated in this case at 250 in FIG. 16, where the auxiliary electromagnetic field source 230, including coils 232 and 234, is incorporated as a part of the receiver package 94, as indicated at 252. When the receiver 252 is lowered into the drill string for field measurement, it is dropped into an orienting key 254 so that its relationship to the drill string will be known. The "stand alone" source 230 is connected via the wireline to the surface so that it can be controlled remotely by the wire line apparatus. Aside from controlling the stand alone field source, the system operates as disclosed above with respect to FIG. 3.

In still another embodiment, the auxiliary source carried by the receiver 94 can be a solenoid, in which case the source must be somewhat stronger but can be powered from an AC source at the surface using a wire line conductor from the surface. In this case the wire line instrument still performs the other functions discussed above; i.e., it still provides excitation for the drill string electrode which emits formation current for the target well and transmits the data received from the drill bit instrument to the surface. In this embodiment, an electromagnetic source with a dipole axis perpendicular to the drill string axis is mounted at the distal end of the receiver tool 94 which sets into the orienting plate 254 in the drill string above the MWD 88.

Another embodiment of the invention is illustrated at 270 in FIG. 17, wherein an auxiliary magnetic field source 272, which is a dipole magnetic source such as a solenoid with its axis perpendicular to the drill string, is part of a totally integrated MWD system 274. In this case, the entire MWD package 274 is battery powered, with the conventional MWD electronics doing the normal drilling functions of determining the current borehole direction and inclination. This MWD package 274 also incorporates the receiver equipment of the receiver package 94 as well as electromagnetic target location determining functions. In this case the MWD 274 controls the drill bit instrument, the electrode power for delivering current to the target well, and energizes the auxiliary electromagnetic dipole source for determining the drill bit instrument orientation.

Although the present invention has been described in terms of preferred embodiments, it will be understood that numerous modifications and variations may be made without departing from the true spirit and scope thereof, as defined in the following claims.

What is claimed is:

1. Apparatus for target detection from a borehole being drilled, comprising:

a drill string having multiple drill pipe sections connected end to end and carrying a drill bit;

at least one of said drill pipe sections being electrically conductive to provide a drill pipe electrode section;

at least one electrically insulating drill pipe sub electrically isolating said electrode section from adjacent drill pipe sections;

a power supply in electrical communication with said at least one drill pipe electrode section and energizable to inject a time varying current into Earth formations surrounding said borehole to cause current flow in a target;

an alternating electromagnetic dipole source in said drill string whose magnetic axis is substantially perpendicular to said drill string, for producing an auxiliary magnetic field;

a sensor instrument at said drill bit for detecting magnetic fields produced by said current flow in a target and by said dipole source to determine a rotational orientation of the direction of drilling with respect to the direction to said target; and communication electronics located in said drill string for establishing communication between said sensor instrument and surface instrumentation for sending data to said surface instrumentation.

2. The apparatus of claim 1, wherein said dipole source is a solenoid mounted in said drill string.

3. The apparatus of claim 1, wherein said dipole source comprises electrical coils mounted in said drill string.

4. The apparatus of claim 1, wherein said magnetic fields produced by said injected current and by said dipole source have different frequencies.

5. A method for target detection from a borehole being drilled, comprising:

connecting multiple drill pipe sections end to end to form a drill string carrying a drill bit, wherein at least one of said drill pipe sections is electrically conductive to provide a drill pipe electrode section;

electrically isolating an electrode section of said drill string from adjacent drill pipe sections;

supplying power to said electrode section to inject a time varying current into Earth formations surrounding said borehole to produce a target magnetic field;

locating a dipole source in said drill string to produce an auxiliary alternating electromagnetic field whose magnetic axis is perpendicular to said drill string;

detecting the magnetic fields produced by said injected current and by said dipole at a sensor instrument at said drill bit to determine a rotational orientation of said sensor instrument with respect to said target; and establishing communication between said sensor instrument and surface instrumentation for sending detected magnetic field data to the surface instrumentation.

6. The method of claim 5, including mounting a solenoid in said drill string to produce said dipole source.

7. The method of claim 5, including mounting electrical coils in said drill string to produce said dipole source.

8. The method of claim 5, wherein producing said injected current and said dipole magnetic fields includes supplying said injected current and supplying energizing current to said dipole at different frequencies.

9. A method for determining the direction of drilling a borehole with respect to the direction to a target location, comprising:

positioning a dipole source on a drilling assembly to produce a first alternating magnetic field having an axis substantially perpendicular to the borehole;

producing a second alternating magnetic field at the target location;

measuring the first and second alternating magnetic fields at a drill bit instrumentation sub;

measuring an angular orientation of the dipole source with respect to the angular orientation of the drill bit instrumentation sub; and determining, from said first and second fields and the angular orientation of the dipole source with respect to the angular orientation of the drill bit instrumentation sub, the direction of drilling with respect to the direction to the target.

10. The method of claim 9, further including:

energizing the dipole source to produce a magnetic field having a first frequency; and producing said second magnetic field at a second frequency.

11. Apparatus for determining the azimuthal direction to a target location, comprising:

a drilling assembly including a drill bit instrumentation sub in a borehole;

a dipole source on the drilling assembly to produce a first alternating magnetic field having an axis substantially perpendicular to the borehole, said dipole source having a known azimuthal orientation with respect to said drilling assembly;

a second alternating magnetic field produced at the target location; and sensors in the drill bit instrumentation sub for detecting vector components of the first and second alternating magnetic fields, whereby the azimuthal direction from the drill bit instrumentation sub to the target is determined from said first and second fields and the azimuthal orientation of the dipole source with respect to the drill bit instrumentation sub.

12. The apparatus of claim 11, wherein said first and second magnetic fields have different frequencies.

13. The apparatus of claim 11, wherein said dipole source is mounted on a drilling motor sub above and near said drill bit instrumentation sub.

14. The apparatus of claim 11, wherein said drilling assembly includes a drilling motor sub, and wherein said dipole source is mounted on said drilling assembly above the drilling motor sub.

15. The apparatus of claim 14 wherein said dipole source is incorporated in a measurement while drilling package.

* * * * *